US012486743B2

(12) United States Patent
Alharbi

(10) Patent No.: US 12,486,743 B2
(45) Date of Patent: Dec. 2, 2025

(54) PRODUCING HYDROCARBONS FROM MULTIPLE FORMATIONS

(71) Applicant: Saudi Arabian Oil Company, Dhahran (SA)

(72) Inventor: Moataz Mohammad Alharbi, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/663,750

(22) Filed: May 14, 2024

(65) Prior Publication Data

US 2025/0354467 A1 Nov. 20, 2025

(51) Int. Cl.

| | |
|---|---|
| ***E21B 43/14*** | (2006.01) |
| ***E21B 33/124*** | (2006.01) |
| ***E21B 34/06*** | (2006.01) |
| ***E21B 34/16*** | (2006.01) |
| ***E21B 43/12*** | (2006.01) |
| ***E21B 47/07*** | (2012.01) |

(52) U.S. Cl.

CPC ..... *E21B 43/14* (2013.01); *E21B 33/124* (2013.01); *E21B 34/06* (2013.01); *E21B 34/16* (2013.01); *E21B 43/12* (2013.01); *E21B 47/07* (2020.05)

(58) Field of Classification Search

CPC ..... E21B 43/14; E21B 43/12; E21B 33/124; E21B 34/06; E21B 34/16; E21B 47/07

See application file for complete search history.

(56) References Cited

U.S. PATENT DOCUMENTS

| | | | | |
|---|---|---|---|---|
| 5,193,615 | A | 3/1993 | Akkerman | |
| 5,955,666 | A * | 9/1999 | Mullins | E21B 43/14 340/853.2 |
| 7,165,615 | B2 | 1/2007 | Vinegar et al. | |
| 8,701,777 | B2 * | 4/2014 | Gano | E21B 34/06 166/373 |
| 9,127,539 | B2 | 9/2015 | Maier et al. | |
| 10,711,588 | B2 | 7/2020 | Saponja et al. | |
| 10,883,349 | B2 | 1/2021 | Campbell et al. | |
| 10,907,457 | B2 | 2/2021 | Alharbi | |
| 10,989,012 | B2 | 4/2021 | Hrabovsky | |
| 11,162,344 | B2 | 11/2021 | Alharbi | |
| 11,719,068 | B2 | 8/2023 | Hrupp et al. | |
| 11,773,688 | B2 | 10/2023 | Rothnie et al. | |

(Continued)

*Primary Examiner* — Brad Harcourt
(74) *Attorney, Agent, or Firm* — Fish & Richardson P.C.

(57) ABSTRACT

A system includes production tubing, a first packer, a second packer, one or more first ports, and one or more first conduits. The production tubing extends downhole through multiple subsurface formations including a first formation and a second formation that are gas-bearing formations and a third formation separating the first formation and the second formation. The first packer is positioned in the third formation. The second packer is positioned uphole of the formations. The one or more first ports extend through the production tubing downhole of the first packer. The first ports are movable between an open configuration and a closed configuration. The one or more first conduits extend from a first opening in an outer surface of the production tubing to a second opening in the outer surface of the production tubing, with a first valve positioned between the first opening and the second opening.

20 Claims, 6 Drawing Sheets

(56) References Cited

U.S. PATENT DOCUMENTS

| | | | | |
|---|---|---|---|---|
| 2010/0038093 | A1* | 2/2010 | Patel | E21B 43/12 166/373 |
| 2016/0186544 | A1* | 6/2016 | Greci | E21B 43/16 166/305.1 |
| 2018/0187533 | A1* | 7/2018 | Al-Gouhi | E21B 43/162 |
| 2020/0240266 | A1* | 7/2020 | Hunter | E21B 43/14 |
| 2020/0386073 | A1* | 12/2020 | Joubran | E21B 34/08 |
| 2021/0277757 | A1 | 9/2021 | Swist | |
| 2021/0333186 | A1* | 10/2021 | Greci | G01N 9/26 |
| 2023/0366306 | A1 | 11/2023 | Saponja et al. | |
| 2024/0218775 | A1 | 7/2024 | Alharbi | |

* cited by examiner

PRODUCING HYDROCARBONS FROM MULTIPLE FORMATIONS

TECHNICAL FIELD

This disclosure relates to oil and gas production.

BACKGROUND

Oil and gas production includes drilling, completing, and operating a production wellbore formed in one or more hydrocarbon-bearing formations. Such subsurface formations have oil, gas, or both trapped within the rock of the formations. Some formations are more productive than others. Improvements to the methods and equipment for producing oil and gas from subsurface formations are sought.

SUMMARY

Implementations of the present disclosure include a system for producing gas from multiple subsurface formations through a wellbore. The system includes production tubing, a first packer, a second packer, one or more first ports, and one or more first conduits. The production tubing extends downhole through the subsurface formations. The subsurface formations include a first formation and a second formation that are gas-bearing formations and a third formation separating the first formation and the second formation. There is a space defined between the production tubing and walls of the borehole. The first packer is positioned in the third formation. The second packer is positioned uphole of the formations. The one or more first ports extend through the production tubing downhole of the first packer. The first ports are movable between an open configuration and a closed configuration. The one or more first conduits extend from a first opening in an outer surface of the production tubing to a second opening in the outer surface of the production tubing, with a first valve positioned between the first opening and the second opening.

In some implementations, one or more second ports extend through the production tubing downhole of the second packer. The second ports are movable between an open configuration and a closed configuration. In some implementations, the first opening in the outer surface of the production tubing is positioned in the space defined between the production tubing and walls of the borehole downhole of the first packer and the second opening in the outer surface of the production tubing is positioned in the space defined between the production tubing and walls of the borehole between the first packer and the second packer.

In some implementations, the system further includes sensors measuring pressure in the space defined between the production tubing and walls of the borehole downhole of the first packer and in the space defined between the production tubing and walls of the borehole between the first packer and the second packer.

In some implementations, the system further includes a first water sensor and a second water sensor. The first and second water sensors are positioned in the space defined between the production tubing and walls of the borehole. In some implementations, the first water sensor and the second water sensor are positioned downhole of the first packer. In some implementations, the first water sensor and the second water sensor are positioned between the first packer and the second packer.

In some implementations, at least one lateral has been drilled through the production tubing into the first formation. In some implementations, the method further includes an isolation plug positioned inside the production tubing between an aperture or apertures in the production tubing associated with the at least one lateral and the one or more first ports.

In some implementations, the multiple subsurface formations further include a fourth formation that is a gas-bearing formation and a fifth formation separating the fourth from the second formation. In some implementations, the system further includes a third packer positioned in the fifth formation. In some implementations, the one or more first conduits extend from the first opening in the outer surface of the production tubing to the second opening in the outer surface of the production tubing to a third opening in the outer surface of the production tubing.

Implementations of the present disclosure include a method that includes directing production fluid along a first conduit of a production tubing. The production tubing extends downhole within a wellbore through a multiple subsurface formations. The subsurface formations include a first formation and a second formation that are hydrocarbon-bearing formations and a third formation separating the first formation and the second formation. The production tubing forms, with walls of the wellbore, an annulus. The production tubing includes a first packer positioned in the annulus at the third formation and a second packer positioned uphole of the second formation. The directing includes directing the production fluid from the first formation, thorough the first conduit, to the second formation. The method also includes producing the production fluid from the second formation. The producing includes flowing the production fluid stored in the second formation from the first formation by opening a first fluid port of the production tubing disposed at the second formation, allowing the production fluid to flow uphole through the production tubing to a terranean surface of the wellbore.

In some implementations, the directing includes opening, as a function of sensor feedback received from one or more sensors of the production tubing, a first valve of the first conduit. In some implementations, the one or more sensors include a first pressure sensor and first temperature sensor attached to an uphole-facing surface of the first packer, a second pressure sensor and second temperature sensor attached to a downhole-facing surface of the first packer, and the directing includes opening, as a function of determining that a pressure or temperature within the annulus satisfies a threshold, the valve.

In some implementations, the production tubing further includes a second fluid port at the first formation, and the method further includes, before the directing, closing the first fluid port and the second fluid port.

Implementations of the present disclosure include a system that includes production tubing, a first fluid conduit, a first fluid regulation device, a first packer, a second packer, and one or more fluid ports. The production tubing is disposed within a wellbore extending through multiple subsurface formations. The subsurface formations include a first formation and a second formation that are hydrocarbon-bearing formations and a third formation separating the first formation and the second formation. The production tubing forms, with walls of the wellbore, an annulus. The first fluid conduit is at the production tubing and extends from a first opening in fluid communication with the first formation to a second opening in fluid communication with the second formation. The first fluid regulation device is fluidly coupled to the first fluid conduit. The first packer is positioned in the annulus and resides between the first opening and the second opening. The second packer is positioned at the second formation or uphole of the formations. The one or more first ports extend through the production tubing between the first packer and second packer. The first ports are movable between an open configuration, in which the production tubing produces hydrocarbons from the second formation through the one or more first ports, and a closed configuration, in which the production tubing is fluidly decoupled from the second formation.

In some implementations, the first packer includes a first open hole packer that divides the annulus between a first annulus section at the first formation and a second annulus section at the second formation. The first packer fluidly isolates the first annulus section form the second annulus section.

In some implementations, the first open hole packer includes multiple sensors that include a first pressure sensor and a first temperature sensor both facing the first annulus section, and a second pressure sensor and a second temperature sensor both facing the second annulus section. The first fluid regulation device is controllable as a function of sensor feedback from the multiple sensors.

In some implementations, the first fluid regulation device includes a valve controllable from a terranean surface of the wellbore to regulate a flow of fluid between the first formation and the second formation.

Particular implementations of the subject matter described in this specification can be implemented so as to realize one or more of the following advantages. For example, the production system of the present disclosure allows a wellbore to produce gas from low-pressure formations that are typically not commercially productive, increasing the overall productivity of wellbores. Additionally, the production system of the present disclosure can separate the gas from the water on site before producing the gas, which can reduce the environmental impact of production while saving time and resources.

DETAILED DESCRIPTION OF THE DISCLOSURE

Figure 1:
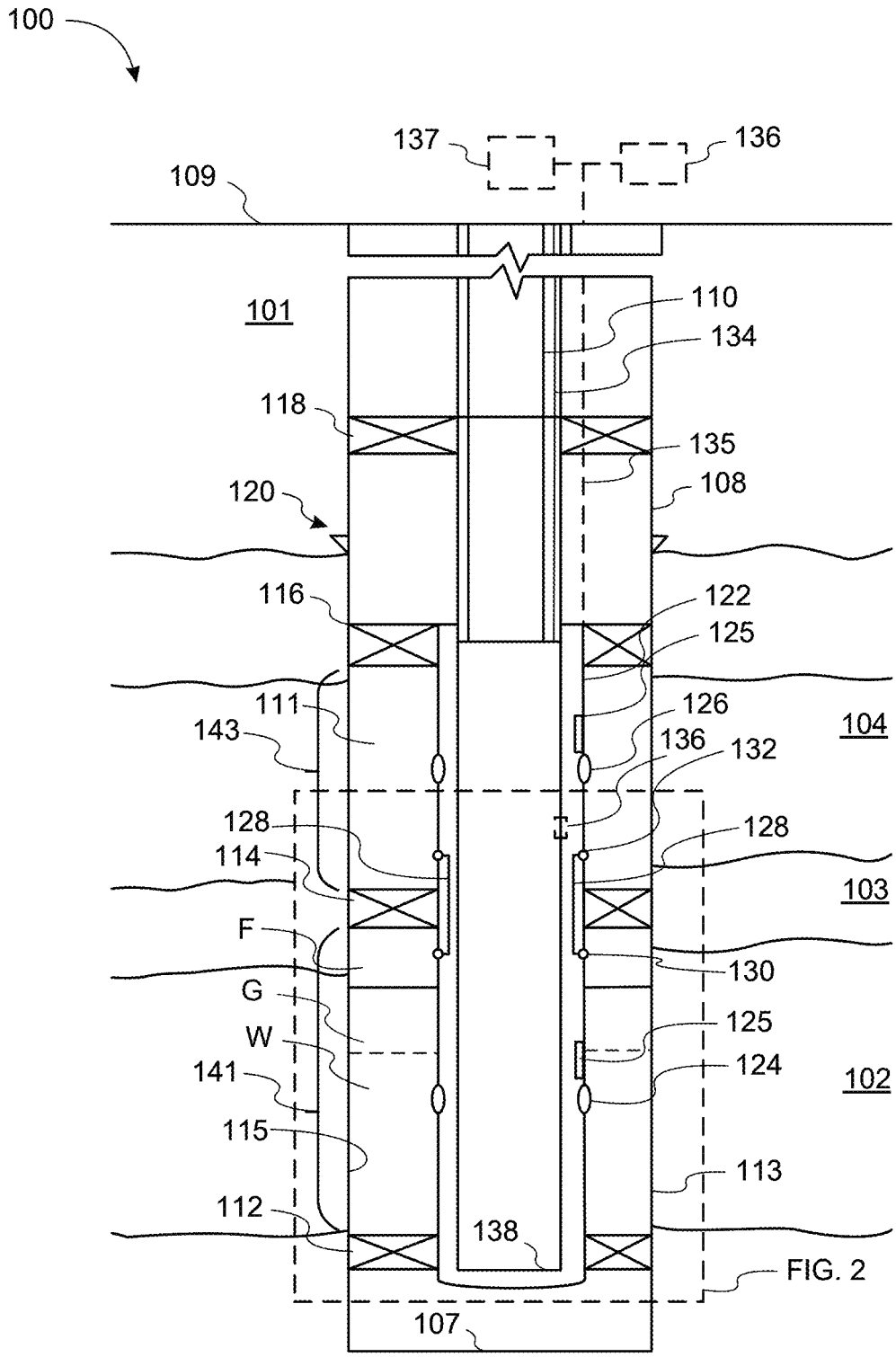
FIG. 1 shows a front schematic view, cross-sectional, of a production system according to a first implementation of the present disclosure.

FIG. 1 shows a system 100 (e.g., a production assembly) for producing gas from multiple subsurface formations (e.g., geologic subterranean formations) 102, 103, 104. The system 100 is used to automatically (or manually) route hydrocarbons (e.g., production fluid "F" including oil or gas) from a non-productive subterranean formation to a productive subterranean formation to increase the rate of production. The system 100 produces hydrocarbons through a wellbore 108 that extends through a subterranean zone 101 that includes the multiple geologic formations 102, 103, 104. For example, the wellbore 108 extends down from a terranean surface 109 of the wellbore 108 and is formed in the geologic formations 102, 103, 104, some or all of which have hydrocarbon reservoirs from which hydrocarbons can be extracted.

The system 100 includes production tubing 110, a liner hanger 118, and a production assembly 120 (e.g., a liner completion or smart completion) attached to a downhole end of the production tubing 110. During hydrocarbon production, the production tubing 110, liner hanger 118, and production assembly 120 (e.g., in-situ production assembly) reside within the wellbore 108 to produce hydrocarbons from one or more of the formations 102, 103, 104. The wellbore 108 can be partially cased, with an open hole section 113. As shown in FIG. 1, the open hole section 113 can extend to the downhole end 107 of the wellbore 108 or, alternatively, section 113 can be at an intermediate section that does not extend to the downhole end 107 of the wellbore 108. The production tubing 110 and production assembly 120 form, with walls 115 (e.g., open hole walls) of the wellbore 108, a space 111 (e.g., an annulus).

The formations include a first formation 102, a second formation 104, and a third formation 103 separating the first formation 102 from the second formation 104. In some aspects, the third formation 103 is a non-hydrocarbon-bearing formation and the first and second formations 102, 104 are hydrocarbon-bearing formations. The formations 102, 103, 104 can be, for example, carbonate formations, sandstone formations, shale formations, source rock formations, or a combination thereof. For example, the first formation 102 can be a sandstone formation, the second formation 104 a carbonate formation, and the third formation 103 a shale formation. In some aspects, one of the first formation 102 or second formation 104 are not commercially viable (e.g., is not commercially productive). The production assembly 120 allows hydrocarbons to be produced from the non-commercially productive formation by routing the hydrocarbons from such formation to a productive (or production-ready) zone or formation.

The production assembly 120 includes a tubular housing 122 and multiple packers (e.g., open hole, permanent packers) 112, 114, 116 attached to the housing 122. When set, the packers divide the annular space 111 into a first annular section or space 141 and a second annular section or space 143. The first section 141 is defined between the first packer 112 and the second packer 114, and the second section 143 is defined between the second packer 114 and the third packer 116. In some aspects, the production assembly 120 does not have the first packer 112 such that the first section 141 extends from the second packer to the downhole end 107 of the wellbore 108.

The packers 112, 114, 116 can be mechanical packers, swellable packers, inflatable packers, metal expandable packers, etc. In some aspects, the packers 112, 114, 116 are used to isolate non-productive formations (e.g., formation 103) from the productive formations (e.g., formations 102, 104). The non-productive formation 103 can be a formation without any or with limited amounts of oil and gas. In some aspects, instead of placing one packer 114 in each of the non-productive formations, each non-productive formation can be isolated by two or more packers (see FIG. 4). For example, a pair of packers can isolate the non-productive formation to increase the isolation integrity of the production system 100. Multiple packers can be used to ensure that the production fluid is routed only to the production-ready formation and no gas is lost in an non-productive formation. In cases in which the non-productive formations are extremely tight, however, and the gas cannot flow into these formations, one packer is sufficient to isolate such section.

Figure 2:
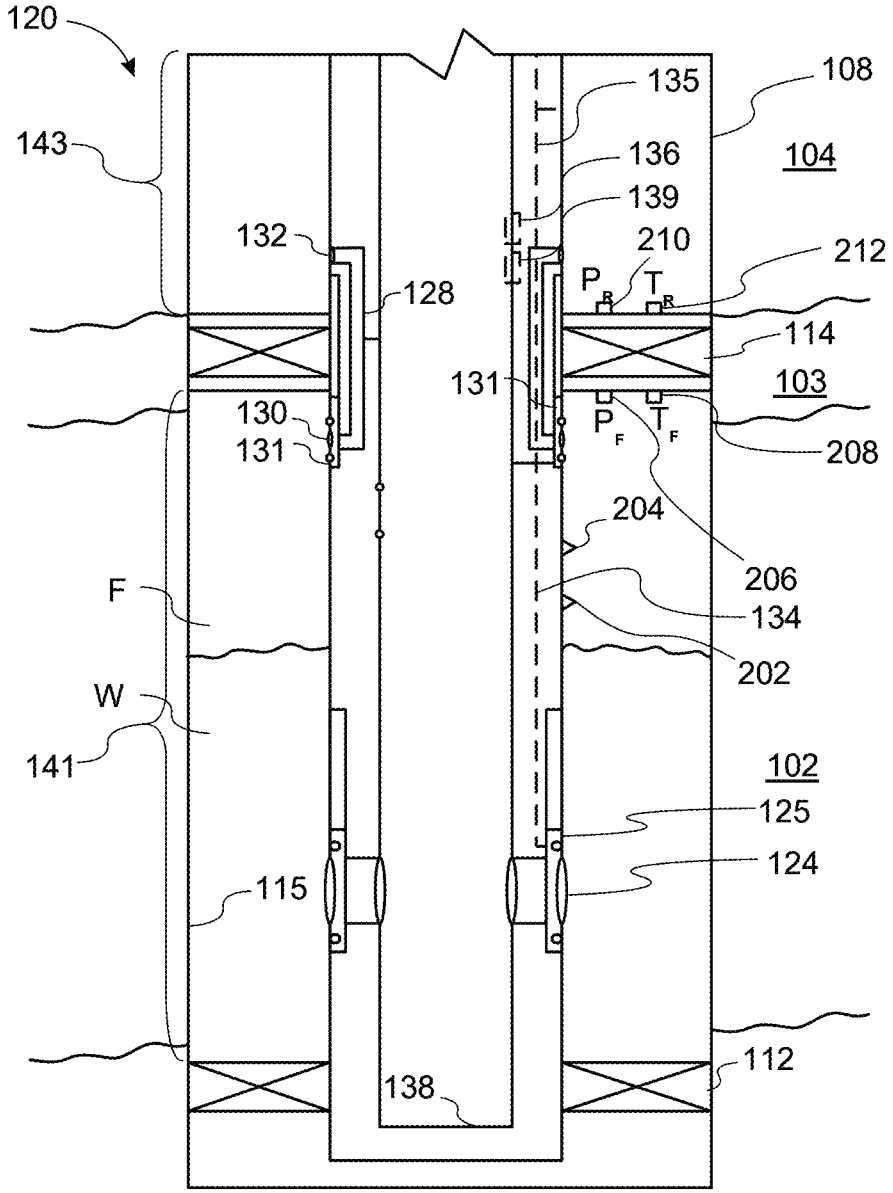
FIG. 2 shows a detailed view of a section of the production system in FIG. 1.

The production assembly 120 also includes one or more first fluid ports 124, one or more second fluid ports 126, and one or more fluid conduits 128. The first fluid ports 124 are disposed in the first space 141 and the second fluid ports 126 are disposed in the second space 143. In some aspects, the production assembly 120 includes only one fluid conduit 128. Referring also to FIG. 2, the production assembly 120 also includes a valve 125 at or near each fluid port 124, 126, fluid conduit valves 131, multiple sensors 202, 204, 206, 208, 210, 212, a controller 136, and a power source 139 (e.g., a battery pack). In some aspects, the controller 136 and sensors are powered by the power source 139. The controller 136 controls the valves 125, 131 as a function of sensor feedback from one or more of the sensors 202, 204, 206, 208, 210, 212. As shown in FIG. 1, the controller 136 can reside at a downhole location, e.g., be part of the production assembly 120, or can reside at the terranean surface 109 of the wellbore 108, e.g., near the wellbore 108 or at a remote location away from the wellbore. The fluid conduit valves 131 are disposed at the inlet opening 130, outlet opening 132, or somewhere along the conduit 128 between the openings 130, 132.

In some aspects, as shown in FIG. 2, the fluid port valves 125 and the fluid conduit valves 131 are solenoid valves, gate valves, check valves, butterfly valves, etc. The valves 125, 131 can be controlled electrically, wirelessly, mechanically, pneumatically, or hydraulically. For example, the controller 136 is electrically connected, through a cable 135 (or multiple cables), to the valves 125, 131. The controller 136 controls (e.g., opens and closes) the valves 125, 131 as a function of sensor feedback received from ore or more of the sensors 202, 204, 206, 208, 210, 212.

For example, the cable 135 includes multiple control lines that extend from the terranean surface 109 to the production assembly 120. In some aspects, the cable 135 also includes a fiber-optics string to provide a real-time or near real-time temperature profile along the length of the wellbore 108 and across the different formations 102, 103, 104. The temperature profile can be used to monitor parameters of the stimulation fluids injected into the different formations 102, 104 to optimize, control, or change the parameters of the stimulation operations. In addition, the fiber-optics string can be installed in the production assembly 120 to acquire real-time information of micro-seismic events during the fracturing operations from the same wellbore to determine the real-time development and propagation of the fracture geometry. The sensors 202, 204, 206, 208, 210, 212 can be electrically connected to the controller 136 and provide real-time or near real-time parameters during the stimulation treatment injection across the different formations. The sensors can not only provide feedback to the controller but also real-time data for the stimulation and production phase of the well.

In some aspects, as shown in FIG. 1, the valves 125, 131 are controlled through a mechanical line 134 (e.g., a hydraulic line of pneumatic line) attached to an actuator 137 (e.g., a hydraulic actuator. In some aspects, the electrical line 135 or mechanical line 134 or both are disposed within passages of the tubing and completion that keep the lines 134, 135 safe. In some aspects, the flow of fluid at the production assembly 120 can be controlled with other devices instead of valves 125, 131, such as electrical or mechanical actuators, movable gates or plugs, etc.

The controller 136 is connected to the fluid port valves 125, the fluid conduit valves 131, and the multiple sensors 202, 204, 206, 208, 210, 212. In some aspects, the controller 136 is implemented as a distributed computer system disposed partly at the surface and partly within the wellbore 108. The controller 136 can include one or more processors and a computer-readable medium storing instructions executable by the one or more processors to perform the operations described here. In some implementations, the controller 136 can be implemented as processing circuitry, firmware, software, or combinations of them. The controller 136 can transmit signals to the multiple valves 125, 131 to lift production fluid "F" (e.g., hydrocarbons including gas or oil) from the multiple subterranean formations.

In some aspects, the fluid conduit 128 is integrally formed within a wall of the housing 122. Alternatively, the fluid conduit 128 can be a fluid line, hose, or pipe. The fluid conduit 128 extends from a first opening 130 (e.g., a fluid inlet) to a second opening 132 (e.g., a fluid outlet). The fluid openings 130, 132 extend from the outer surface of the housing 122 and are interconnected by the fluid conduit 128. When the production assembly 120 is set in the wellbore 108, the first opening 130 is in fluid communication with the first formation 102 and the second opening 132 is in fluid communication with the second formation 104.

Additionally, the middle packer 114 is set between the first opening 130 and second opening 132. Moreover, the uphole packer 116 resides uphole of the formations 102, 103, 104, and the downhole packer 112 resides downhole of the formations 102, 103, 104. The first annular section 141 contains production fluid "F" from the first formation (until the first formation 102 is depleted) and the second annular section 143 contains production fluid from the second formation 104 (until the second formation 104 is depleted). Thus, once the second formation 104 is depleted or produced to a predetermined level, the fluid conduit 128 receives, through the first opening 130, production fluid "F" from the first formation 102 accumulated in the first section 141. Then, the fluid conduit 128 directs the production fluid "F" to the second section 142. Thus, the production fluid "F" is routed to the second section 143 and then produced to the terranean surface 109 through the second fluid ports 126 (shown in FIG. 1).

As shown in FIG. 2, the downhole fluid ports 124 and uphole fluid ports 126 (shown in FIG. 1) are movable between an open configuration and a close configuration. For example, the valves 125 at the fluid ports 124, 126 are controlled by the controller 136 or from the surface to open and close, thus regulating the amount of fluid that flows through the fluid ports 124, 126. In some aspects, the fluid ports 124, 126 open to allow fluid (e.g., water, proppant, or chemical additives) to be injected to treat the gas-bearing formations 102, 104, e.g., to fracture the formations 102, 104. Thus, the production assembly 120 can be set (e.g., permanently set) and then used to both treat the wellbore 108 and produce hydrocarbons.

Once the formations 102, 104 have been treated, the controller 136 closes the first port 124 and leaves the second port 126 open. Hydrocarbons are produced from the second formation 104 through the second fluid ports 126 until the second formation 104 is depleted. Once or while the second formation 104 is depleted, the production assembly 120 closes the fluid ports 124, 126 and opens the first opening 130 to direct the production fluid "F" from the first formation 102 to the second formation 104. Specifically, the production assembly 120 routes the production fluid "F" in the first section 141 to the second section 143, which acts as an accumulation or hosting reservoir. For example, once the second formation 104 is depleted, the first formation 102 has a greater fluid pressure than the second formation 104, creating a pressure differential that allows the gas in the first formation 102 to flow into the second formation 104 without the need of a pump. Once some production fluid "F" has flowed to the second section 143, the second fluid port 126 is opened to produce the production fluid "F" through the tubing 110 to the surface 109.

Conversely, if the second formation 104 is the non-commercially productive formation and the first formation 102 is the productive formation, the production assembly 120 reverses the direction of the flow. Specifically, the production assembly 120 routes the production fluid "F" from the second section 143, through the conduit 128, to the first section 141, and then produces the production fluid "F" to the surface through the first fluid ports 124.

Still referring to FIG. 2, the multiple sensors include a first pressure sensor 206, a second pressure sensor 210, a first temperature sensor 208, a second temperature sensor 212, a first liquid level sensor 202, and a second liquid level sensor 204. The liquid level sensors 202, 204 can include, for example, capacitance sensors, optical sensors, conductivity sensors, vibration sensors, float switch sensors, ultrasonic sensors, radar sensors, etc. The first temperature and pressure sensors 206, 208 face the first section 141 and the second temperature and pressure sensors 210, 212 face the second section 143. The liquid level sensors 202, 204 sense the level of the water or liquid "W" accumulated in the first section 141. For example, the first formation 102 contains water "W" and gas, and the production system 100 only produces the gas, leaving the water "W" downhole.

In some aspects, the first temperature and pressure sensors 206, 208 are attached to an uphole-facing surface of the second packer 114. The first temperature and pressure sensors 206, 208 sense the temperature and pressure of the fluid in the first section 141. The second temperature and pressure sensors 210, 212 are attached to the downhole-facing surface of the second packer 114. The second temperature and pressure sensors 210, 212 sense the temperature and pressure of the fluid in the second section 143.

In some aspects, the first section contains both water "W" and production fluid "F" in form of gas. the liquid level sensors 202, 204 distinguish between the liquids (e.g., the water "W") and gas to detect the liquid levels. In some aspects, the first liquid level sensor 202 is positioned to detect a minimum allowed level of the water "W" and the second liquid level sensor 204 is positioned to detect the maximum allowed level of the water "W." The water level sensors 202, 204 transmit the water level information to the controller 136.

The first pressure sensor 204 and first temperature sensor 208 detect the pressure and temperature of the production fluid "F" and transmit the pressure and temperature information to the controller 136. The controller 136 compares the feedback from the pressure and temperature sensors 204, 208 to respective thresholds and controls, as a function of determining that the sensor feedback satisfies the thresholds, the valves 125, 131. For example, when the controller 136 determines that the pressure and or temperature of the gas is high enough, and that the water level is between the minimum and maximum water level, the controller 136 opens the fluid conduit valve 131 to allow the gas to flow from the first annular section 141 to the second annular section 143.

The controller 136 determines when to close the conduit valve 131 based on the sensor feedback. For example, once a quantity of the gas from the first formation 102 is flowed to the second formation 104, the controller 136 determines, as a function of the pressure and water level, that enough gas has been flowed to the second sensor and thereby closes the first opening 130. Specifically, once the controller 136 determines that the pressure feedback from the first pressure sensor 206 satisfies a minimum pressure threshold and that the water level is at or below the first fluid level sensor 202, the controller closes the first fluid opening 130 by actuating the conduit valve 131.

In some aspects, the process is repeated automatically and autonomously at the predetermined pressures and water levels to extract the gas from the lower formation 102. Additionally, the water "W" continues to be separated from the production gas "F" downhole while extracting the gas from the first formation 102. Additionally, an adjacent, neighboring wellbore (not shown) sharing the reservoir (e.g., the hosting reservoir) of the second formation 104 can produce the hydrocarbons transferred from the reservoir (e.g., the feeding reservoir) of the first formation 102. Moreover, the added pressure in the second formation 104 (or the reduced pressure in the first formation 102) can act as a gas drive to sweep and extract additional hydrocarbons from any surrounding offset oil wells into the wellbore 108.

In some aspects, the controller 136 opens the second fluid port 126 as a function of feedback from the second pressure sensor 210 and second temperature sensor 212. Specifically, once the controller 136 determines that the pressure and/or temperature of the transferred gas in the hosting section 143 is sufficient, the controller 136 opens the valve 125 of the second fluid port 126 to flow the gas to the surface 109.

In addition, at least some of the sensors 202, 204, 206, 208, 210, 212 can be used to monitor the formation response during wellbore stimulation operations. For example, the pressure and temperature sensors 206, 208, 210, 212 are utilized to monitor (e.g., monitor in or near real time) the pressure and temperature of the formations 102, 104 during the fracturing treatment of the formations 102, 104. After the formations 102, 104 have been treated, the production tubing 110 produces hydrocarbons from the respective formations through the respective fluid ports 124, 126 to test the inflow performance of the formations 102, 104.

In some aspects, the first formation 102 is affected by condensate banking, in which cases the production system 120 acts as a downhole gas condensate separator. For example, instead of or in addition to water "W," condensed gas can accumulate at the bottom of the first section 141. The production assembly 120 is able to transfer the gas to the production section 143 while leaving the condensed gas and water in the first section 141. In some aspects, both water "W" and condensate gas "G" can accumulate in the annulus section, where the condensate lies on top of the water. The system can be utilized to separate the condensate from the water downhole and reroute the condensate gas to an oil-bearing formation, where the oil and condensate gas can be produced to enhance the economic value from the well.

Additionally, the first formation 102 can be unconsolidated and produce sand, solids, or fine particles. The production system 120 can have suitable sand control measures (e.g., standalone screens, expandable screens, gravel pack, frac pack, etc.) to address the sanding issue while feeding the hydrocarbons to the host formation 104. Moreover, the in-situ produced gas can be captured with the oil production and sold as associated gas, enhancing the overall hydrocarbon production from the field. For example, if the host formation 104 is an oil-bearing formation, the routed gas from the first formation 102 can be utilized as a gas drive to extract the oil from the formation 104. Capturing the gas with the extracted oil the increase the economic productivity of the well.

The production system 120 can operate automatically, semi-automatically, autonomously, manually, etc. For example, a human operator can manipulate the installed production assembly 120 to achieve the optimum extraction of hydrocarbons, or the system can operate independently as a function of sensor input. Additionally, multiple wells can have a production assembly 120. In such cases, the controller 136 or an operator can control the different production assemblies 120 in each wellbore to counter the depletion and manage the production from different areas and wellbores.

Figure 3:
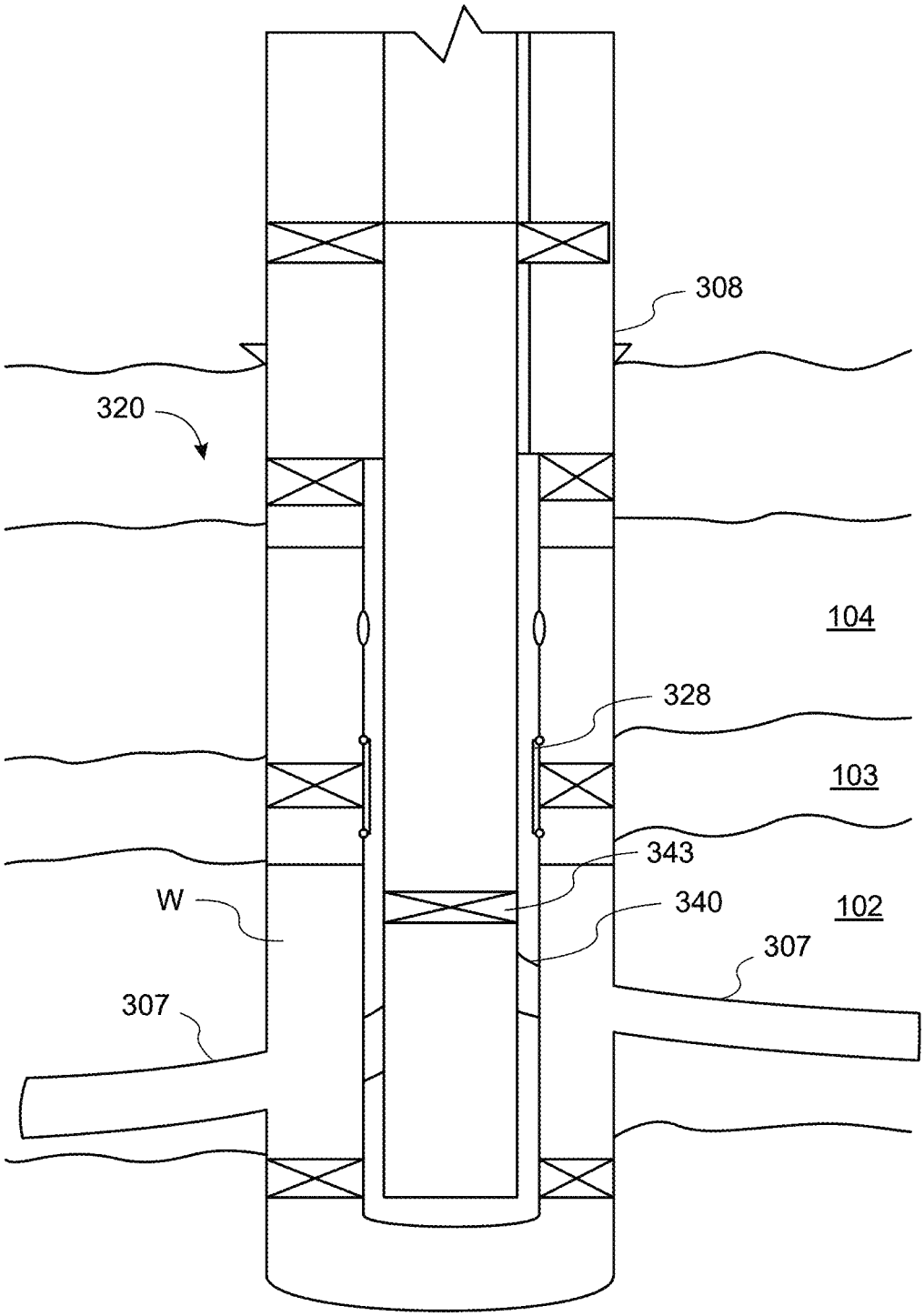
FIG. 3 shows a front schematic view, cross-sectional, of a production system according to a second implementation of the present disclosure.

FIG. 3 shows a production assembly 320 according to a different implementation of the present disclosure. The production assembly 320 is used in a wellbore 308 with one or more lateral wellbores 307 or fractures. The lateral wellbores 307 are drilled to enhance the productivity of the lower formation 102 sufficiently to feed hydrocarbons to the upper formation 104 through the conduit 328.

The lateral wellbores 302 can be formed before or after installing the production assembly 320. For example, the lateral wellbores 307 can be drilled after the production assembly 320 is installed using an underbalanced coiled drill string ran inside the production assembly 320. The coiled drilling string exits the production assembly 320 through outlets 340. After drilling the laterals 307, an isolation plug 343 is installed uphole of the outlets 340 to prevent the water "W" or other liquids from flowing up to the surface 109. Similar to the packers described in FIGS. 1 and 2, the isolation plug 343 can be activated mechanically or electrically. Alternatively, the isolation plug 343 can be installed using a work string deployed from the surface of the wellbore 308.

Figure 4:
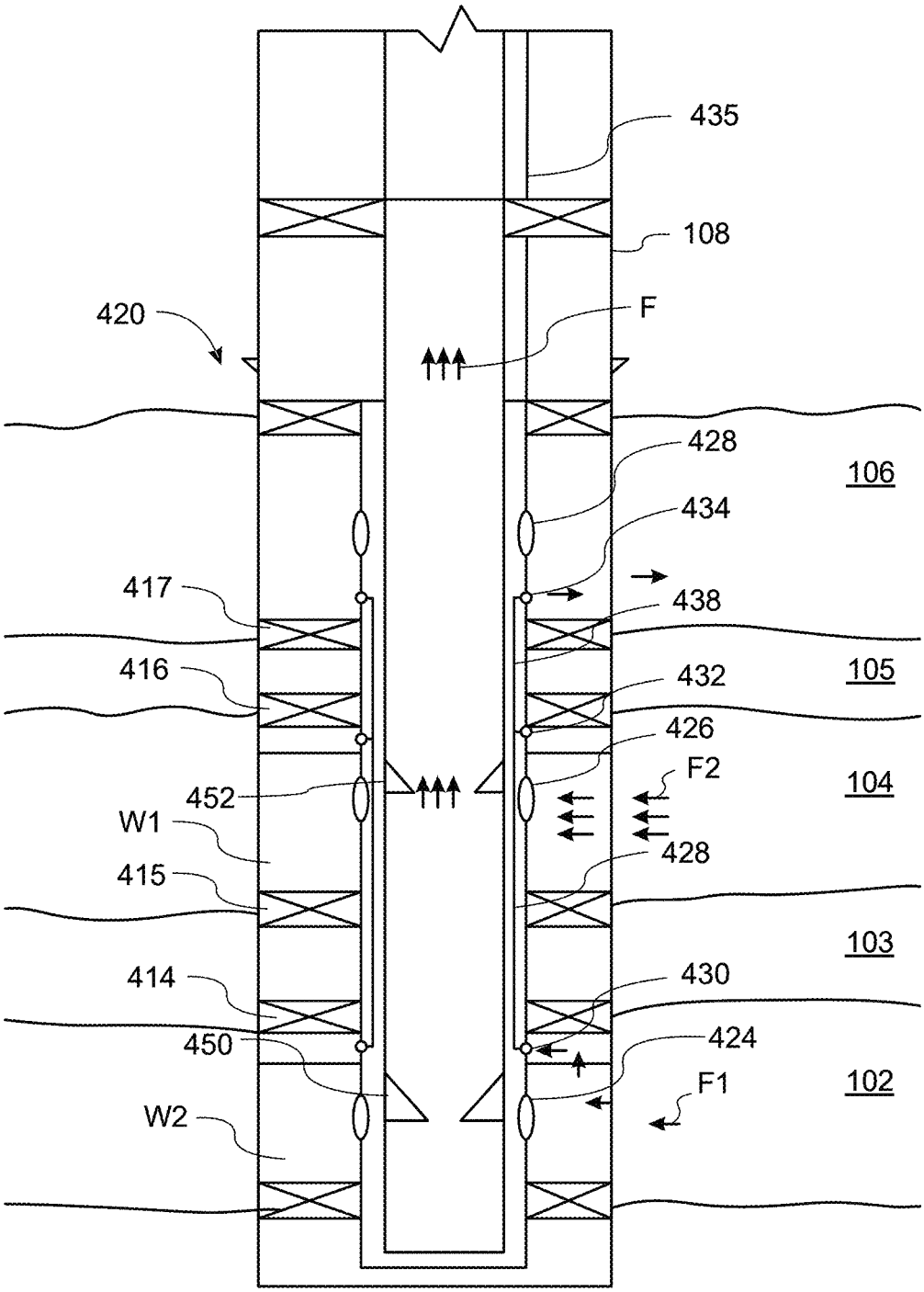
FIG. 4 shows a front schematic view, cross-sectional, of a production system according to a third implementation of the present disclosure.

FIG. 4 shows a production assembly 420 according to a different implementation of the present disclosure. The production assembly 420 is disposed within a wellbore 108 that includes, in addition to formations 102, 103, 104, fourth formation 105 and a fifth formation 106. The first formation 102, second formation 104, and fifth formation 106 are hydrocarbon-bearing formations. The third formation 103 and fourth formation 105 are non-hydrocarbon-bearing formations. The first formation 102 and second formation 104 can act as feeding formations and the fifth formation 106 as the hosting reservoir, from which the transferred hydrocarbons are produced. In some aspects, the first formation 102 and second formation 104 are tight gas bearing formations and the fifth formation 106 is an oil bearing formation.

In some aspects, the production assembly 420 routes first production fluid "F1" from the first formation to the second formation 104. Additionally, the production assembly 420 routes second production fluid "F2" (e.g., a mixture of the first production fluid "F1" with production fluid from the second formation 104) from the second formation 104 to the fifth formation 106. To do so, the production assembly 420 has two fluid conduits 428, 438 that interconnect the hydrocarbon-bearing formations 102, 104, 106. The first fluid conduit 428 extends from a first fluid opening 430 to a second fluid opening 432, and the second fluid conduit 438 extends from the second fluid opening 432 to the third fluid opening 434. In some aspects, the production assembly 420 has more fluid conduits to route hydrocarbons between more formations.

In some aspects, the production assembly 420 routes first production fluid "F1" from the first formation 102 to the fifth formation 106. Additionally, the production assembly 420 routes second production fluid "F2" from the second formation 104 to the fifth formation 106 trough fluid conduits 428, 438 that are interconnected. In this configuration, the first fluid conduit 428 extends from a first fluid inlet opening 430 to the outlet fluid opening 434, and the second fluid conduit 438 extends from the second fluid inlet opening 432 to the outlet fluid opening 434. So, both formations 102 and 104 can feeding to the fifth formation 106. The openings 430, 432 and 434 can be controlled in such a way that the gas will be routed only to the fifth formation 106 and prevent the crossflow between formations 102 and 104.

The production assembly 420 includes multiple pairs of packers that isolate the non-hydrocarbon bearing formations 103, 105 from the hydrocarbon bearing formations 102, 104, 106. For example, a first pair of packers 414, 415 isolate the third formation 103 and a second pair of packers 416, 417 isolate the fourth formation 105.

The production assembly 420 also includes multiple fluid ports 424, 426, 428. When open, the first fluid port 424 is in fluid communication with the first formation 102, the second fluid port 426 is in fluid communication with the second formation 104, and the third fluid port 428 is in fluid communication with the fifth formation 106. Similar to the fluid ports of the production assembly 120 in FIG. 1, the fluid ports 424, 426, 428 allow treatment fluids to be injected into their respective formations and allow production fluid to be directly extracted from their respective formations.

The production assembly 420 also includes two ball seat assemblies 450, 452 each arranged to receive a ball dropped from the surface 109 to close or open, under fluid pressure, the respective fluid ports 424, 426. For example, to open the first fluid port 424, a first ball is dropped from the surface to land on the first ball seat assembly 450. Then, the production assembly 420 is pressurized (e.g., pressurized with fluid injected from the surface of the wellbore) uphole of the first ball seat assembly 450 to push the ball seat assembly 450 downhole under fluid pressure, opening the first fluid port 424.

With the first fluid port 424 open, the production assembly 420 can direct fluid into the first formation 102 to stimulate and test the first formation 102. After the stimulation and testing operations are completed, the first port 424 can be closed using, for example, a work string (e.g., a slickline, e-line, or coiled tubing).

Similarly, to open the second fluid port 426, a second, larger ball is dropped from the surface to land on the second ball seat assembly 452. Then, the production assembly 420 is pressurized uphole of the second ball seat assembly 452 to push the ball seat assembly 452 downhole under fluid pressure, opening the second fluid port 426.

With the second fluid port 426 open, the production assembly 420 can direct fluid into the second formation 104 to stimulate and test the second formation 104. After the stimulation and testing operations are completed, the second port 426 can be closed using, for example, a work string (e.g., a slickline, e-line, or coiled tubing). Alternatively, the fluid ports 424, 426 can be controlled using mechanical lines or electrical control lines, similar to the fluid ports 124, 126 described above with respect to FIGS. 1 and 2.

The third fluid port 428 can be similarly opened and closed, either by using the control lines 435, a ball seat assembly, or a work string as described above with respect to the fluid ports 424, 426. The production assembly 420 can transfer hydrocarbons between any of the hydrocarbon bearing formations 102, 104, 106. For example, if the fifth formation 106 is a commercially productive formation and the first and second formations 102, 104 are non-commercially productive formations, the fifth formation 106 is produced until depleted, and then the first and second formations 102, 104 are produced through the fluid conduits 428, 438. Specifically, once the fifth formation 106 is depleted, the first and second formations 102, 104 have greater fluid pressures than the fifth formation 106, allowing the hydrocarbons in the first and second formations 102, 104 to flow to the fifth formation 106. Similar to the fluid conduit valves in FIGS. 1 and 2, the fluid conduit valves of the fluid conduits 428, 438 are controlled based on sensor feedback to flow the production fluids "F1" and "F2" from the first and second formations 102, 104 to the fifth formation 106.

The hydrocarbon-bearing formations 102, 104, 106 can have liquids such as water "W" or condensed gas. Similar to the production assembly 120 in FIG. 1, the production assembly 420 separates the water from the gas and flows the gas to the hosting reservoir. For example, the production assembly 420 flows the gas from the first reservoir 102 directly to the fifth reservoir 106 of in stages, from the first reservoir 102 to the second reservoir 104, and from the second reservoir 104 to the fifth reservoir 106.

Moreover, the production assembly 420 can flow hydrocarbons between the hydrocarbon bearing formations 102, 104, 106 even when the wellbore is shut in at the surface. Thus, production can continue even after the well is shut in at the surface. Additionally, one hydrocarbon bearing formation can be produced traditionally though its respective fluid port while the other two hydrocarbon bearing formations continue the accumulation process passively. For example, as shown in FIG. 4, the second production fluid "F2" (e.g., production fluid from the second formation 104) is produced from the second formation 104 traditionally, though the fluid port 426. During such production, the production assembly 420 flows hydrocarbons from the first formation 102 to the fifth formation 106 through fluid conduits 428 and 438. Any of the hydrocarbon bearing formations 102, 104, 106 can be produced traditionally while the other two are produced passively by transferring gas from one formation to the other. Thus, the production assembly 420 has a dual function that allows hydrocarbon to be produced both conventionally and in-situ at the same time.

Figure 5:
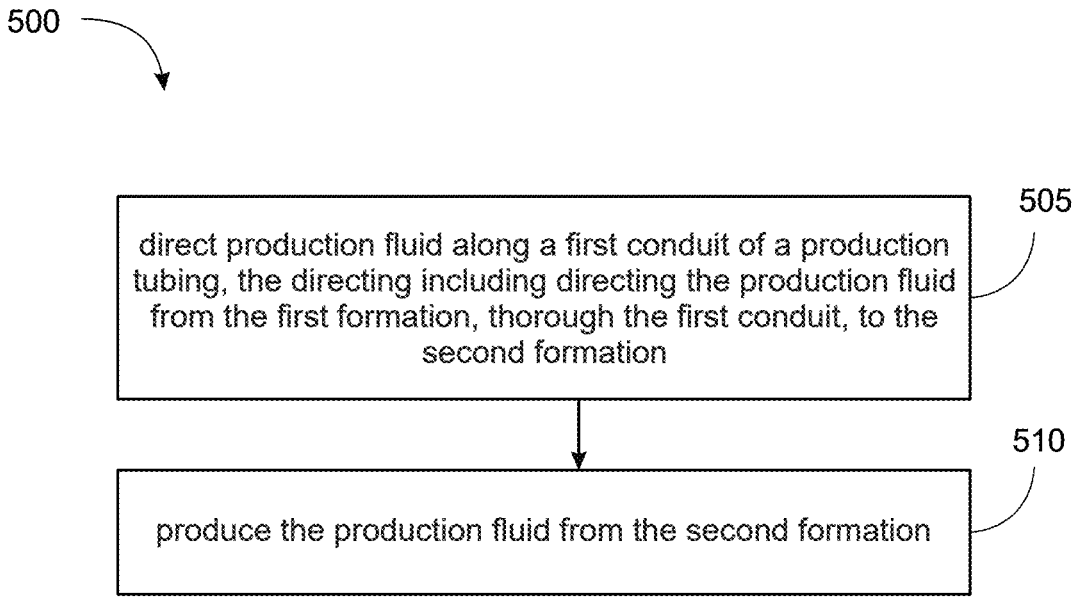
FIG. 5 show a flow chart of an example method of producing hydrocarbons from multiple subsurface formations.

FIG. 5 shows a flow chart of production method (500). The method includes directing production fluid along a first conduit of a production tubing (505). The production tubing extends downhole within a wellbore through a plurality of subsurface formations. The plurality of subsurface formations comprises a first formation and a second formation that are hydrocarbon-bearing formations and a third formation separating the first formation and the second formation. The production tubing forms, with walls of the wellbore, an annulus. The production tubing comprises a first packer positioned in the annulus at the third formation and a second packer positioned uphole of the second formation. The directing comprises directing the production fluid from the first formation, thorough the first conduit, to the second formation. The method also includes producing the production fluid from the second formation (510). The producing comprising flowing the production fluid stored in the second formation from the first formation by opening a first fluid port of the production tubing disposed at the second formation, allowing the production fluid to flow uphole through the production tubing to a terranean surface of the wellbore.

Figure 6:
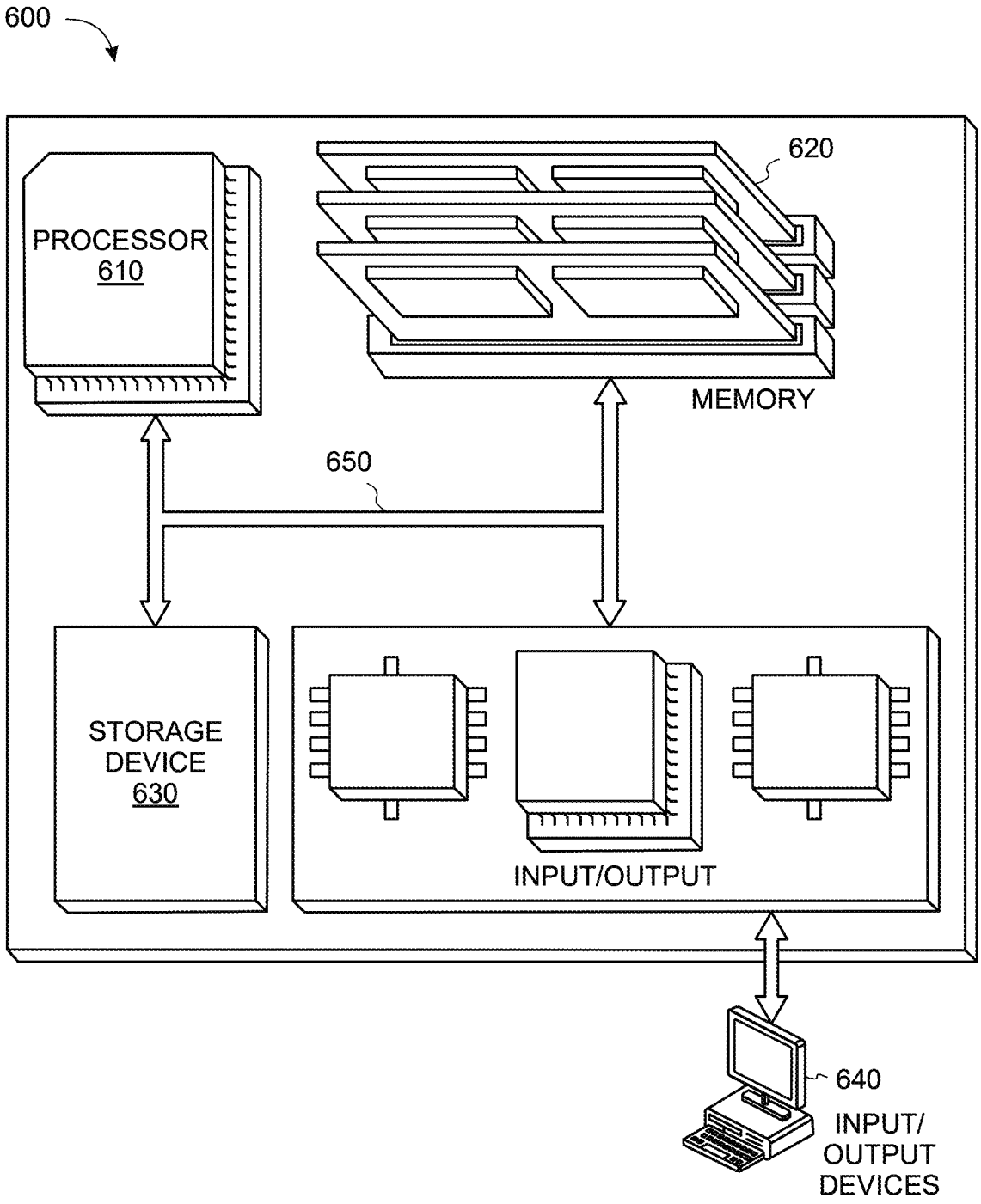
FIG. 6 shows a schematic illustration of an example controller (or control system) for a production system according to an example of the present disclosure.

FIG. 6 is a schematic illustration of an example control system or controller for a plunger lift system according to the present disclosure. For example, the controller 600 may be, include, or be part of the controller 136 shown in FIG. 1. The controller 600 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 600 includes a processor 610, a memory 620, a storage device 630, and an input/output device 640. Each of the components 610, 620, 630, and 640 are interconnected using a system bus 650. The processor 610 is capable of processing instructions for execution within the controller 600. The processor may be designed using any of a number of architectures. For example, the processor 610 may be a CISC (Complex Instruction Set Computers) processor, a RISC (Reduced Instruction Set Computer) processor, or a MISC (Minimal Instruction Set Computer) processor.

In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640.

The memory 620 stores information within the controller 600. In one implementation, the memory 620 is a computer-readable medium. In one implementation, the memory 620 is a volatile memory unit. In another implementation, the memory 620 is a non-volatile memory unit.

The storage device 630 is capable of providing mass storage for the controller 600. In one implementation, the storage device 630 is a computer-readable medium. In various different implementations, the storage device 630 may be a floppy disk device, a hard disk device, an optical disk device, or a tape device.

The input/output device 640 provides input/output operations for the controller 600. In one implementation, the input/output device 640 includes a keyboard and/or pointing device. In another implementation, the input/output device 640 includes a display unit for displaying graphical user interfaces.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

Examples

In an example implementation, a system for producing gas from multiple subsurface formations through a wellbore includes production tubing, a first packer, a second packer, one or more first ports, and one or more first conduits. The production tubing extends downhole through the subsurface formations. The subsurface formations include a first formation and a second formation that are gas-bearing formations and a third formation separating the first formation and the second formation. There is a space defined between the production tubing and walls of the borehole. The first packer is positioned in the third formation. The second packer is positioned uphole of the formations. The one or more first ports extend through the production tubing downhole of the first packer. The first ports are movable between an open configuration and a closed configuration. The one or more first conduits extend from a first opening in an outer surface of the production tubing to a second opening in the outer surface of the production tubing, with a first valve positioned between the first opening and the second opening.

In an example implementation combinable with any other example implementation, one or more second ports extend through the production tubing downhole of the second packer. The second ports are movable between an open configuration and a closed configuration.

In an example implementation combinable with any other example implementation, the first opening in the outer surface of the production tubing is positioned in the space defined between the production tubing and walls of the borehole downhole of the first packer and the second opening in the outer surface of the production tubing is positioned in the space defined between the production tubing and walls of the borehole between the first packer and the second packer.

In an example implementation combinable with any other example implementation, the system further includes sensors measuring pressure in the space defined between the production tubing and walls of the borehole downhole of the first packer and in the space defined between the production tubing and walls of the borehole between the first packer and the second packer.

In an example implementation combinable with any other example implementation, the system further includes a first water sensor and a second water sensor. The first and second water sensors are positioned in the space defined between the production tubing and walls of the borehole.

In an example implementation combinable with any other example implementation, the first water sensor and the second water sensor are positioned downhole of the first packer.

In an example implementation combinable with any other example implementation, the first water sensor and the second water sensor are positioned between the first packer and the second packer.

In an example implementation combinable with any other example implementation, at least one lateral has been drilled through the production tubing into the first formation.

In an example implementation combinable with any other example implementation, the method further includes an isolation plug positioned inside the production tubing between an aperture or apertures in the production tubing associated with the at least one lateral and the one or more first ports.

In an example implementation combinable with any other example implementation, the multiple subsurface formations further include a fourth formation that is a gas-bearing formation and a fifth formation separating the fourth from the second formation.

In an example implementation combinable with any other example implementation, the system further includes a third packer positioned in the fifth formation.

In an example implementation combinable with any other example implementation, the one or more first conduits extend from the first opening in the outer surface of the production tubing to the second opening in the outer surface of the production tubing to a third opening in the outer surface of the production tubing.

In an example implementation, a method includes directing production fluid along a first conduit of a production tubing. The production tubing extends downhole within a wellbore through multiple subsurface formations. The subsurface formations include a first formation and a second formation that are hydrocarbon-bearing formations and a third formation separating the first formation and the second formation. The production tubing forms, with walls of the wellbore, an annulus. The production tubing includes a first packer positioned in the annulus at the third formation and a second packer positioned uphole of the second formation. The directing includes directing the production fluid from the first formation, thorough the first conduit, to the second formation. The method also includes producing the production fluid from the second formation. The producing includes flowing the production fluid stored in the second formation from the first formation by opening a first fluid port of the production tubing disposed at the second formation, allowing the production fluid to flow uphole through the production tubing to a terranean surface of the wellbore.

In an example implementation combinable with any other example implementation, the directing includes opening, as a function of sensor feedback received from one or more sensors of the production tubing, a first valve of the first conduit.

In an example implementation combinable with any other example implementation, the one or more sensors include a first pressure sensor and first temperature sensor attached to an uphole-facing surface of the first packer, a second pressure sensor and second temperature sensor attached to a downhole-facing surface of the first packer, and the directing includes opening, as a function of determining that a pressure or temperature within the annulus satisfies a threshold, the valve.

In an example implementation combinable with any other example implementation, the production tubing further includes a second fluid port at the first formation, and the method further includes, before the directing, closing the first fluid port and the second fluid port.

In an example implementation, a system includes production tubing, a first fluid conduit, a first fluid regulation device, a first packer, a second packer, and one or more fluid ports. The production tubing is disposed within a wellbore extending through multiple subsurface formations. The subsurface formations include a first formation and a second formation that are hydrocarbon-bearing formations and a third formation separating the first formation and the second formation. The production tubing forms, with walls of the wellbore, an annulus. The first fluid conduit is at the production tubing and extends from a first opening in fluid communication with the first formation to a second opening in fluid communication with the second formation. The first fluid regulation device is fluidly coupled to the first fluid conduit. The first packer is positioned in the annulus and resides between the first opening and the second opening. The second packer is positioned at the second formation or uphole of the formations. The one or more first ports extend through the production tubing between the first packer and second packer. The first ports are movable between an open configuration, in which the production tubing produces hydrocarbons from the second formation through the one or more first ports, and a closed configuration, in which the production tubing is fluidly decoupled from the second formation.

In an example implementation combinable with any other example implementation, the first packer includes a first open hole packer that divides the annulus between a first annulus section at the first formation and a second annulus section at the second formation. The first packer fluidly isolates the first annulus section form the second annulus section.

In an example implementation combinable with any other example implementation, the first open hole packer includes multiple sensors that include a first pressure sensor and a first temperature sensor both facing the first annulus section, and a second pressure sensor and a second temperature sensor both facing the second annulus section. The first fluid regulation device is controllable as a function of sensor feedback from the multiple sensors.

In an example implementation combinable with any other example implementation, the first fluid regulation device includes a valve controllable from a terranean surface of the wellbore to regulate a flow of fluid between the first formation and the second formation.

What is claimed is:

1. A system for producing gas from a plurality of subsurface formations through a wellbore, the system comprising:

production tubing extending downhole through the plurality of subsurface formations, wherein the plurality of subsurface formations comprise a first formation and a second formation that are gas-bearing formations and a third formation separating the first formation and the second formation, a space defined between the production tubing and walls of the wellbore;

a first packer positioned in the third formation;

a second packer positioned uphole of the plurality of formations;

one or more first ports extending through the production tubing downhole of the first packer, the first ports movable between an open configuration and a closed configuration; and one or more first conduits extending from a first opening in an outer surface of the production tubing to a second opening in the outer surface of the production tubing with a first valve positioned between the first opening and the second opening, the one or more first conduits arranged to direct production gas between the first formation and the second formation.

2. The system of claim 1, further comprising one or more second ports extending through the production tubing downhole of the second packer, the second ports movable between an open configuration and a closed configuration.

3. The system of claim 2, wherein the first opening in the outer surface of the production tubing is positioned in the space defined between the production tubing and walls of the borehole downhole of the first packer and the second opening in the outer surface of the production tubing is positioned in the space defined between the production tubing and walls of the borehole between the first packer and the second packer, wherein the first opening is in fluid communication with the first formation and the second opening is in fluid communication with the second formation, and flow of the production gas in the one or more first fluid conduits is regulated by the first valve.

4. The system of claim 1, further comprising sensors measuring pressure in the space defined between the production tubing and walls of the borehole downhole of the first packer and in the space defined between the production tubing and walls of the borehole between the first packer and the second packer.

5. The system of claim 4, further comprising a first water sensor and a second water sensor, the first and second water sensors positioned in the space defined between the production tubing and walls of the borehole.

6. The system of claim 5, wherein the first water sensor and the second water sensor are positioned downhole of the first packer.

7. The system of claim 5, wherein the first water sensor and the second water sensor are positioned between the first packer and the second packer.

8. The system of claim 1, wherein the plurality of subsurface formations further comprise a fourth formation that is a gas-bearing formation and a fifth formation separating the fourth from the second formation.

9. The system of claim 8, further comprising a third packer positioned in the fifth formation.

10. The system of claim 9, wherein the one or more first conduits extending from the first opening in the outer surface of the production tubing to the second opening in the outer surface of the production tubing to a third opening in the outer surface of the production tubing.

11. A method, comprising:

directing production fluid along a first conduit of a production tubing, the production tubing extending downhole within a wellbore through a plurality of subsurface formations, the plurality of subsurface formations comprising a first formation and a second formation that are hydrocarbon-bearing formations and a third formation separating the first formation and the second formation, the production tubing forming, with walls of the wellbore, an annulus, the production tubing comprising a first packer positioned in the annulus at the third formation and a second packer positioned uphole of the second formation, the directing comprising directing the production fluid from the first formation, thorough the first conduit, to the second formation; and producing the production fluid from the second formation, the producing comprising flowing the production fluid stored in the second formation from the first formation by opening a first fluid port of the production tubing disposed at the second formation, allowing the production fluid to flow uphole through the production tubing to a terranean surface of the wellbore.

12. The method of claim 11, wherein the directing comprises opening, as a function of sensor feedback received from one or more sensors of the production tubing, a first valve of the first conduit.

13. The method of claim 12, wherein the one or more sensors comprise a first pressure sensor and first temperature sensor attached to an uphole-facing surface of the first packer, a second pressure sensor and second temperature sensor attached to a downhole-facing surface of the first packer, and the directing comprises opening, as a function of determining that a pressure or temperature within the annulus satisfies a threshold, the valve.

14. The method of claim 11, wherein the production tubing further comprises a second fluid port at the first formation, the method further comprising, before the directing, closing the first fluid port and the second fluid port.

15. A system, comprising:

production tubing disposed within a wellbore extending through a plurality of subsurface formations, the plurality of subsurface formations comprising a first formation and a second formation that are hydrocarbon-bearing formations and a third formation separating the first formation and the second formation, the production tubing forming, with walls of the wellbore, an annulus;

a first fluid conduit at the production tubing and extending from a first opening in fluid communication with the first formation to a second opening in fluid communication with the second formation, the first fluid conduit arranged to direct production fluid between the first formation and the second formation;

a first fluid regulation device fluidly coupled to the first fluid conduit and arranged to regulate a flow of the production fluid in the first fluid conduit;

a first packer positioned in the annulus and residing between the first opening and the second opening;

a second packer positioned at the second formation or uphole of the plurality of formations; and one or more first ports extending through the production tubing between the first packer and second packer, the first ports movable between an open configuration, in which the production tubing produces hydrocarbons from the second formation through the one or more first ports, and a closed configuration, in which the production tubing is fluidly decoupled from the second formation.

16. The system of claim 15, wherein the first packer comprises a first open hole packer that divides the annulus between a first annulus section at the first formation and a second annulus section at the second formation, the first packer configured to fluidly isolate the first annulus section form the second annulus section.

17. A system, comprising:

production tubing disposed within a wellbore extending through a plurality of subsurface formations, the plurality of subsurface formations comprising a first formation and a second formation that are hydrocarbon-bearing formations and a third formation separating the first formation and the second formation, the production tubing forming, with walls of the wellbore, an annulus;

a first fluid conduit at the production tubing and extending from a first opening in fluid communication with the first formation to a second opening in fluid communication with the second formation a first fluid regulation device fluidly coupled to the first fluid conduit a first packer positioned in the annulus and residing between the first opening and the second opening;

a second packer positioned at the second formation or uphole of the plurality of formations; and one or more first ports extending through the production tubing between the first packer and second packer, the first ports movable between an open configuration, in which the production tubing produces hydrocarbons from the second formation through the one or more first ports, and a closed configuration, in which the production tubing is fluidly decoupled from the second formation;

wherein the first packer comprises a first open hole packer that divides the annulus between a first annulus section at the first formation and a second annulus section at the second formation, the first packer configured to fluidly isolate the first annulus section form the second annulus section; and wherein the first open hole packer comprises a plurality of sensors comprising a first pressure sensor and a first temperature sensor both facing the first annulus section, and a second pressure sensor and a second temperature sensor both facing the second annulus section, the first fluid regulation device controllable as a function of sensor feedback from the plurality of sensors.

18. A system, comprising:

production tubing disposed within a wellbore extending through a plurality of subsurface formations, the plurality of subsurface formations comprising a first formation and a second formation that are hydrocarbon-bearing formations and a third formation separating the first formation and the second formation, the production tubing forming, with walls of the wellbore, an annulus;

a first fluid conduit at the production tubing and extending from a first opening in fluid communication with the first formation to a second opening in fluid communication with the second formation a first fluid regulation device fluidly coupled to the first fluid conduit a first packer positioned in the annulus and residing between the first opening and the second opening;

a second packer positioned at the second formation or uphole of the plurality of formations; and one or more first ports extending through the production tubing between the first packer and second packer, the first ports movable between an open configuration, in which the production tubing produces hydrocarbons from the second formation through the one or more first ports, and a closed configuration, in which the production tubing is fluidly decoupled from the second formation;

wherein the first fluid regulation device comprises a valve controllable from a terranean surface of the wellbore to regulate a flow of fluid between the first formation and the second formation.

19. A system for producing gas from a plurality of subsurface formations through a wellbore, the system comprising:

production tubing extending downhole through the plurality of subsurface formations, wherein the plurality of subsurface formations comprise a first formation and a second formation that are gas-bearing formations and a third formation separating the first formation and the second formation, a space defined between the production tubing and walls of the wellbore;

a first packer positioned in the third formation;

a second packer positioned uphole of the plurality of formations;

one or more first ports extending through the production tubing downhole of the first packer, the first ports movable between an open configuration and a closed configuration; and one or more first conduits extending from a first opening in an outer surface of the production tubing to a second opening in the outer surface of the production tubing with a first valve positioned between the first opening and the second opening;

wherein at least one lateral has been drilled through the production tubing into the first formation.

20. The system of claim 19, further comprising an isolation plug positioned inside the production tubing between an aperture or apertures in the production tubing associated with the at least one lateral and the one or more first ports.

* * * * *